US005697590A

United States Patent [19]

Hull et al.

[11] Patent Number: 5,697,590

[45] Date of Patent: Dec. 16, 1997

[54] COUPLING MEMBER FOR ATTACHING AN OBJECT TO A ROLLER BAR HAVING A PERIPHERAL RETAINER CHANNEL

[76] Inventors: Harold L. Hull, 401 Canyon Way #43, Sparks, Nev. 89434; Randall G. Williams, Rte. 2, Box 93, Bishop, Calif. 93514

[21] Appl. No.: 274,766

[22] Filed: Jul. 14, 1994

[51] Int. Cl.[6] ..... A47B 96/06

[52] U.S. Cl. ..... 248/225.1; 248/251; 248/273

[58] Field of Search ..... 248/225.1, 220.2, 248/220.3, 279, 287, 297.2, 298, 300, 304, 307, 273, 215, 251; 16/87.4, 96 R; 160/66, 67, 45, 47

[56] References Cited

U.S. PATENT DOCUMENTS

| | | | |
|---|---|---|---|
| 2,287,667 | 6/1942 | Brown | 248/273 X |
| 3,175,243 | 3/1965 | Weber | 16/87.4 R |
| 3,378,879 | 4/1968 | Stall | 16/87.4 R |
| 3,522,621 | 8/1970 | Ford et al. | 16/87.4 R |
| 4,461,443 | 7/1984 | Dauman | 248/220.3 |
| 4,593,824 | 6/1986 | Pfeifer | 248/220.3 X |
| 4,989,815 | 2/1991 | McAuley | 248/220.3 X |
| 5,174,536 | 12/1992 | Pelletier | 248/339 |
| 5,246,052 | 9/1993 | Homan | 160/65 |
| 5,421,059 | 6/1995 | Leffers | 16/87.4 R |

*Primary Examiner*—Ramon O. Ramirez
*Assistant Examiner*—Charles J. Hunter

[57] ABSTRACT

Herein disclosed is a coupling member which cooperates with a roller bar having a peripheral retainer channel and is used to attach an object, such as an awning to the roller bar. The member is of one-piece, integral construction and includes a hook-shaped portion which is capable of grasping and securing an object when attached thereto and a retainer channel engagement portion, with its engagement portion being of a shape and size to slidably engage within a peripheral retainer channel.

2 Claims, 1 Drawing Sheet

COUPLING MEMBER FOR ATTACHING AN OBJECT TO A ROLLER BAR HAVING A PERIPHERAL RETAINER CHANNEL

FIELD OF THE INVENTION

The present invention relates to coupling members but is more particularly directed to a coupling member which is of one-piece, integral construction, including a hook shaped portion and a retainer channel engagement portion, with its engagement portion being of a shape and size to slidably engage within a peripheral retainer channel.

BACKGROUND OF THE INVENTION

It is well known in the industry that most recreational vehicles include an annular roller bar for supporting an awning fabric and most often they will provide the roller bar with an awning fabric which is attached thereto. The attachment of the awning fabric to the roller bar is typically made by providing the roller with internally disposed C-shaped retainer channels disposed at spaced positions around the annular periphery of the roller and extending along the axial length of the roller. An arrangement of this type is disclosed in U.S. Pat. No. 4,640,332. Another type of coupling member used for attaching awnings is disclosed in U.S. Pat. No. 5,246,052, wherein they provide an awning hook which is an arcuate shaped device having a unitary construction, including an arcuate main section, which contains a hook element at the distal end and a generally straight proximal end section with an aperture formed therein. The device is placed over the roller tube in a circumferential fashion and wraps around the tube to a distance of approximately 50% of the tube's circumference in the limited area of each end of the tube where it connects, engages a groove having a distinct downward facing orientation at a point approximately 180 degrees from the place where the proximal end of the device would naturally come to rest.

Yet another type of coupling member for awnings is taught in U.S. Pat. No. 5,174,536, wherein they provide an awning hook having a bead which is retained within the C-shaped retainer channels and includes a body portion which extends from the bead and a hole is provided in the body portion to receive a member such as a hook.

These prior art devices are functional for their intended use however, each have inherent drawbacks such as U.S. Pat. Nos. 5,246,052 and 4,640,332 in which they teach a coupling member which cooperates with a retractable awning mounted on a recreational vehicle. Unfortunately, retractable awnings have multiple parts which tend to cause problems such as jamming or binding and many times tearing of the awning material is incurred.

U.S. Pat. No. 5,174,536 is similar to present invention, however, as disclosed they teach a bead being an integral part of the body portion and is made from material or fabric which can easily be torn and/or disengaged from the bead portion whereby defeating the function and purpose of the attachment means. A further drawback is incurred due to the design of the hook portion which is basically an S-shaped member inserted into a hole on the body portion of the coupling member and is therefor a separate part which can easily be disengaged and/or lost especially when there is a lack of tension applied to the ends of the S-shaped member. Also, as noted by the present inventors, this awning hook as claimed is not designed to attach an awning material to a recreational vehicle but is designed and used only for suspending various objects from the awning roller bar such as potted plants, clothes hangers, and messages. Also, as noted by the applicants, the hook portion when attached to the roller bar extends in a downward position, so as to allow the hook to suspend objects when attached thereto. The present invention, unlike the '536 reference, allows the hook portion to extend in an outward and upward direction, whereby allowing the hook portion to grasp and secure an object when attached thereto, such as an awning.

It is therefor obvious that a need exists for a simple, functional, and convenient coupling member which cooperates with an existing roller bar having a peripheral retainer channel for attaching an awning, tarp, or the like, such as taught and disclosed within the present invention.

SUMMARY OF THE INVENTION

The present invention provides a coupling member in the form of a unique hook design having a hook-shaped body portion and a retainer channel engagement portion, which are one integral part. The hook portion being of a shape and size to grasp and secure an awning or the like when hooked thereto, while the retainer channel engagement portion has a substantially circular cross-section, a longitudinal axis and a length along its axis greater than the diameter of its cross-section and being sized to be disposed in a C-shaped peripheral channel such as used with a typical awning roller bar. The invention may be made from any suitable material such as wood, plastic, nylon, ect. and is most economical to manufacture.

It is therefor a primary object of the present invention to provide a new and improved coupling member to attach an awning or the like to a roller bar having a peripheral retainer channel, such as used with a typical awning roller bar.

Another object of the present invention is to provide a coupling member which includes a uniquely shaped hook portion which is of a shape and size to grasp and secure an object such as an awning or the like when attached thereto.

Yet another object is to provide a coupling member which includes a uniquely shaped retainer channel engagement portion which is substantially in the form of a bead which is of a size and shape to slidably engage within a peripheral retainer channel.

Still another object is to provide a coupling member which is one integral piece which may be easily manufactured by an injection mold.

A further object is to provide a coupling member which may be made from any suitable material such as plastic, wood, nylon, vinyl, or the like, depending on engineering choice.

Also another object is to provide a coupling member which may be produced in a variety of colors so as to be pleasing to the eye.

Yet another object is to provide a coupling member which is strong and durable.

Other objects and advantages will become apparent when taken into consideration with the following drawings and specifications.

DETAILED DESCRIPTION OF THE DRAWINGS

Figure 1:
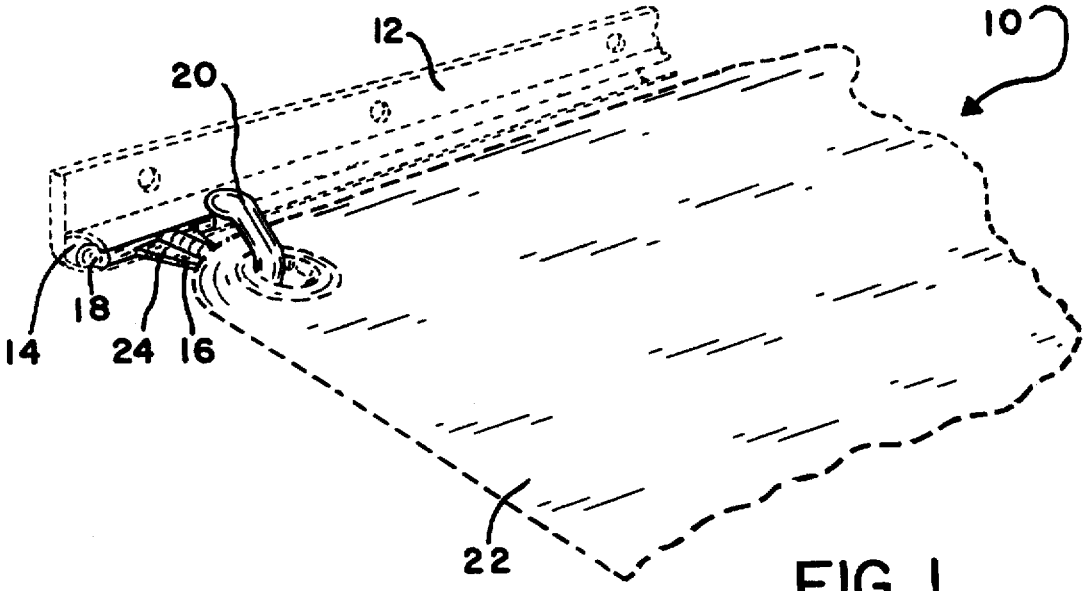
FIG. 1, is a perspective view which shows the coupling member when attached to a prior art retainer channel and awning, as shown in ghost lines.
Figure 2:
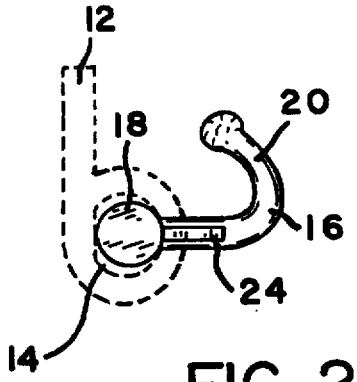
FIG. 2, is a side view of the coupling member when engaged within the retainer channel, with the retainer channel shown in ghost lines.
Figure 3:
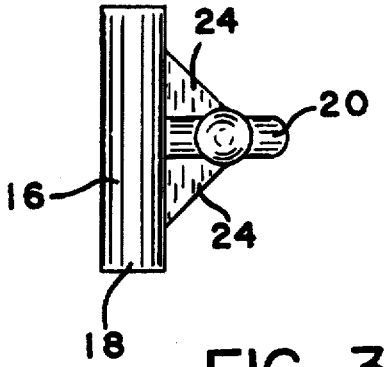
FIG. 3, is a top view of the coupling member.

Referring now in detail to the drawings wherein like characters refer to like elements throughout the various views. As shown in FIG. 1, arrow 10 is an overview of the invention while 12 is a roller bar having at least one peripheral retainer channel 14 therein, channel 14 may be formed into any suitable shape such as circular, square, triangular or as shown in the preferred embodiment, it may be a C-shaped peripheral retainer channel, 16 is a coupling member having a retainer channel engagement portion 18 and a hook-shaped body portion 20, engagement portion 18 and body portion 20 being of one-piece integral construction and is made from any suitable material such as wood, plastic, nylon or the like. Portion 18 may be formed into any suitable shape such as circular, square, triangular or as shown in the preferred embodiment, it may be a bead-shaped retainer channel engagement portion. Portion 18 being sized to be disposed within channel 14 and has a slidable relationship therein. Hook-shaped body portion 20 is of a size and shape to grasp and secure an object when attached thereto, such as an awning 22. The coupling member 16 may include a pair of substantially triangular-shaped gussets 24 which provide added strength and support. The gussets 24 extend horizontally in an outward direction extending from portion 18, to body portion 20, as clearly shown in FIG. 3.

It will now be seen that when coupling member 16 is engaged within retainer channel 14, member 16 extends substantially horizontally in an outward direction and hook portion 20 extends substantially vertically in an upward direction whereby, allowing hook portion 20 to grasp and secure an object when hooked thereto, such as an awning.

It will now be seen that we have provided a new and improved coupling member which may be used to attach an awning or the like to a roller bar having a peripheral retainer channel.

It will also be seen that we have provided a coupling member which is of a unique design and includes a hook-shaped portion and a uniquely shaped retainer channel engagement portion which is substantially in the shape of a bead and is of a size and shape to slidably engage within a peripheral retainer channel.

Also, the coupling member is of one-piece, integral construction.

It will further be seen that the coupling member as disclosed can be made from a variety of materials but is preferably made from plastic which can be produced by an injection mold which is strong and durable.

Although the invention has been shown and described in what is conceived to be the most practical and preferred embodiment, it is recognized that departures may be made therefrom within the scope and spirit of the invention, which is knot to be limited to the details disclosed herein but is to be accorded the full scope of the claims so as to embrace any and all equivalent devices and apparatus.

Having described our invention, what we claim as new and desire to secure by letters patent is:

1. A coupling member in combination with a roller bar having at least one C-shaped peripheral retainer channel therein comprising: a bead-shaped retainer channel engagement portion, a hook-shaped body portion, and a pair of substantially triangular-shaped gussets, each said portion and said gussets being of one-piece integral construction, said bead portion having substantially a circular cross-section, a longitudinal axis and a length along said axis which is greater than the diameter of said cross-section and being sized to be disposed within said C-shaped channel in a sliding relationship therein, said hook-shaped body portion being of a size and shape to grasp and secure an object when attached thereto, said engagement portion when engaged within said retainer channel extends substantially horizontally in an upward direction away from said channel, said hook-portion extends substantially vertically in an upward direction away from said channel and said gussets substantially align with said channel.

2. A coupling member in combination with a roller bar having at least one D-shaped peripheral retainer channel therein comprising: a bead-shaped retainer channel engagement portion, a hook-shaped body portion, and a pair of substantially triangular-shaped gussets, each said portion and said gussets being of one-piece integral construction, said bead portion having substantially a circular cross-section, a longitudinal axis and a length along said axis which is greater than the diameter of said cross-section and being sized to be disposed within said D-shaped channel in a sliding relationship therein, said hook-shaped body portion being of a size and shape to grasp and secure an object when attached thereto, said engagement portion when engaged within said retainer channel extends substantially horizontally in an upward direction away from said channel, said hook-portion extends substantially vertically in an upward direction away from said channel and said gussets substantially align with said channel.

* * * * *